United States Patent [19]

Cecil

[11] Patent Number: 4,945,891

[45] Date of Patent: Aug. 7, 1990

[54] DRIVE MECHANISM FOR RETRACTABLE DOWN DRAFT VENT

[75] Inventor: Rebecca J. Cecil, Louisville, Ky.

[73] Assignee: General Electric Company, Louisville, Ky.

[21] Appl. No.: 331,415

[22] Filed: Mar. 30, 1989

[51] Int. Cl.[5] ..... F24C 15/20

[52] U.S. Cl. ..... 126/299 D; 126/299 R; 98/115.4; 49/375; 49/349

[58] Field of Search ..... 126/299 R, 299 D, 299 F, 126/300; 98/115.4; 49/131-134, 375, 374, 362, 349

[56] References Cited

U.S. PATENT DOCUMENTS

| | | | |
|---|---|---|---|
| 2,194,747 | 3/1940 | Giffoniello et al. | 49/375 X |
| 2,674,991 | 4/1954 | Schaefer | 126/299 |
| 2,804,297 | 8/1957 | Lenz et al. | 49/375 X |
| 3,011,492 | 12/1961 | Humbert | 126/299 |
| 3,102,533 | 9/1963 | Jenn et al. | 126/303 |
| 3,409,005 | 11/1968 | Field | 126/300 |
| 3,712,819 | 1/1973 | Field | 99/400 |
| 4,446,849 | 5/1984 | McFarland | 126/299 |
| 4,501,260 | 2/1985 | Grace | 126/299 |
| 4,744,172 | 5/1988 | Miyauchi | 49/349 |

FOREIGN PATENT DOCUMENTS

| | | |
|---|---|---|
| 58-104432 | 6/1983 | Japan . |
| 60-30916 | 2/1985 | Japan . |

*Primary Examiner*—Larry Jones

*Attorney, Agent, or Firm*—H. Neil Houser; Radford M. Reams

[57] ABSTRACT

An improved driving mechanism for a motor driven retractable down draft vent system of the type having a vent inlet member slidably mounted for vertical movement between a lowered position and a raised position. A first drive member is fixedly connected to a drive motor which drives the first drive member between a first position and a second position corresponding to the lowered and raised positions of the vent member, respectively. A second drive member supported from the movable vent inlet member is disposed in the path of the first drive member. The first drive member abuttingly drivingly engages the second drive member in moving from its first to its second position to positively drive the vent inlet member from its lowered to its raised position. The second drive member is simply driven by the weight of the vent inlet member to follow the first drive member when it returns from its second to its first position to releasably carry the vent inlet member to its lowered position. Since there is no positive connection between the first and second drive members, the only force applied to an obstruction blocking the return of the vent inlet member will be the weight of the vent inlet member itself. Consequently, neither the obstruction, the vent inlet member nor the motor is likely to be damaged.

6 Claims, 5 Drawing Sheets

DRIVE MECHANISM FOR RETRACTABLE DOWN DRAFT VENT

BACKGROUND OF THE INVENTION

This invention relates to motor driven retractable down draft vent systems for use with range and cooktop appliances.

Down draft ventilation systems for cooktops and ranges which locate the vent inlet opening at an elevated level above the cooktop are well known in the art. Such arrangements are particularly advantageously employed with ranges and cooktops which employ gas surface units so as to prevent the air drawn into the vent from interfering with surface unit operation.

An example of a motor driven retractable down draft vent system may be found in U.S. Pat. No. 4,510,260 to Grace. In the drive arrangement therein disclosed for raising and lowering the retractable vent structure, the retractable vent member is positively connected to the motor through a bellcrank arm pivotally connected at one end to the vent member and at the other end to a wheel driven by the motor. By this arrangement the vent member is pushed upward from its lowered position to its raised position as the drive wheel is rotated by the motor through half a turn. It is pulled to its lowered position when the wheel completes its rotation. Switches are located proximate the wheel to deenergize the motor when the vent member reaches the raised and lowered positions.

A major disadvantage of the drive arrangement above described is that although the pivotally mounted coupling structures employ slot and pin pivot structures which presumably allow limited vertical movement or play of the vent member relative to the drive structure, the positive drive of the motor in returning the vent to its retracted position could exert excessive force on an object obstructing the return of the vent member to its retracted position, resulting in potential damage to the object, the vent member and/or the motor.

It is therefore an object of the present invention to provide a drive mechanism for raising and lowering the vent member which freely disengages from the vent member and continues unhindered to its recessed position in the event an obstacle blocks the return of the vent member to its lowered position.

SUMMARY OF THE INVENTION

The present invention provides an improved driving mechanism for a motor driven retractable down draft vent system of the type having a vent inlet member slidably mounted for vertical movement between lowered position and a raised position. The improvement comprises drive means coupling the drive motor to the retractable vent inlet member, operative to abuttingly engage the vent inlet member to positively drive the vent member from its lowered position to its raised position and to releasably carry the vent member from its raised position to its lowered position.

In a preferred form of the invention a first drive member is fixedly connected by linking means to a drive motor which positively drives the first drive member between a first position and a second position corresponding to the lowered and raised positions of the vent member respectively. A second drive member supported from the movable vent inlet member is disposed in the path of the first drive member. The first drive member abuttingly drivingly engages the second drive member in moving from its first to its second position to positively drive the vent inlet member from its lowered to its raised position. There is no positive coupling of the first and second drive members. Thus, the second drive member is simply driven by the weight of the vent inlet member to follow the first drive member when it returns from its second to its first position to releasably carry the vent inlet member to its lowered position. By this arrangement, should an obstruction in the path of the vent inlet member block its return to its lowered position, the first drive member freely disengages the second drive member and continues to its first position unhindered by the obstruction. There being no positive connection between the first and second drive members, the only force then applied to such an obstruction will be the weight of the vent inlet member. Consequently, neither the obstruction, the vent inlet member nor the motor is likely to be damaged.

BRIEF DESCRIPTION OF THE DRAWINGS

While the novel aspects of the invention are set forth with particularity in the appended claims, the invention both as to organization and content will be better understood and appreciated from the following detailed description taken in conjunction with the drawings in which:

DETAILED DESCRIPTION

Figure 1:
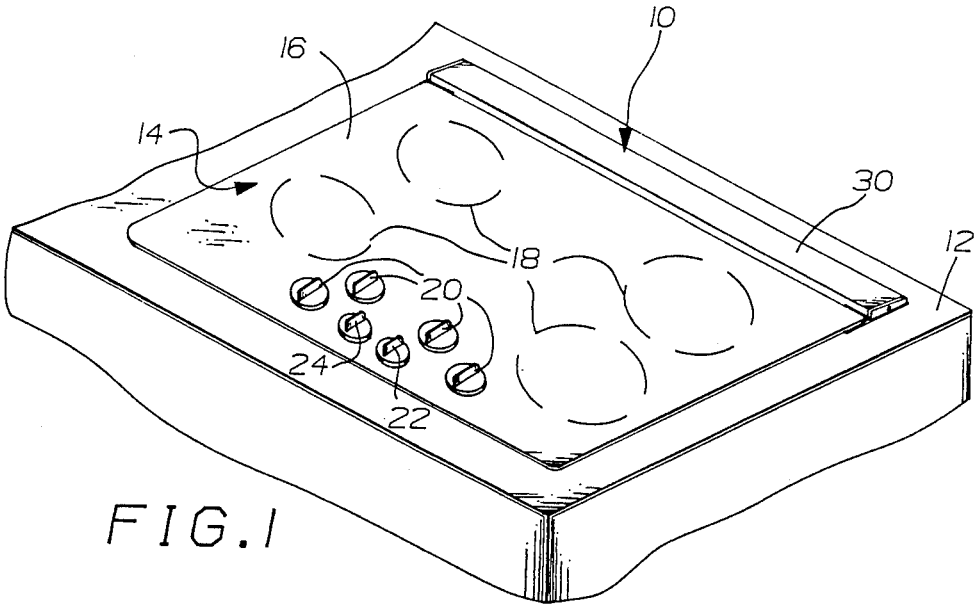
FIG. 1 is a perspective view of a retractable down draft vent system embodying the improved drive mechanism of the present invention disposed proximate the cooktop of a cooking appliance, showing the vent inlet member in its lowered or retracted position.
Figure 2:
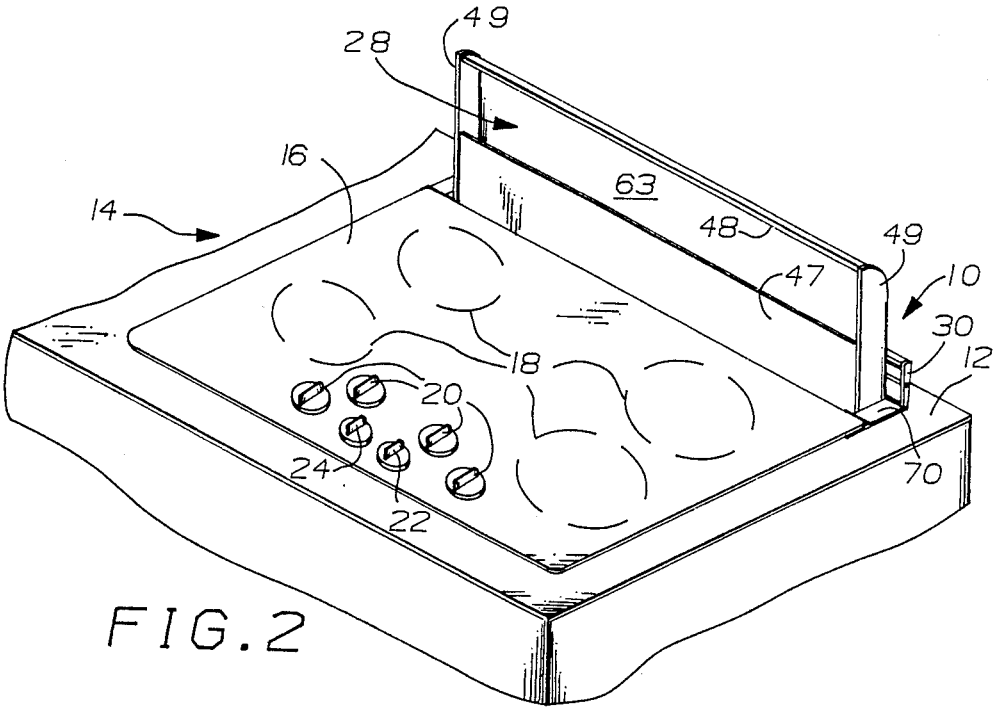
FIG. 2 is a perspective view of the vent system of FIG. 1 showing the vent inlet member in its raised position.

Referring now primarily to FIGS. 1–5, a retractable down draft vent system designated generally 10 is shown disposed in countertop 12 along the rear edge of cooktop cooking appliance 14 having a cooking surface 16 supported from the countertop 12. Cooktop 16 includes a plurality of surface heating units illustrated schematically at 18. The vent system herein described is particularly advantageously used with gas burners, as the exhaust air flow is sufficiently higher than the surface so as not to interfere with the gas flames. However, the ventilation system is not limited to any particular type of heating arrangement. The surface units could be sheathed electric resistance heaters, radiant heaters, induction units or solid disk heaters as well.

Control knobs 20 enable the user to select the desired heating level for each of the surface units 18. Control knob 22 enables the user to control the exhaust blower (not shown) and control knob 24 enables the user to raise and lower the retractable vent.

Figure 3:
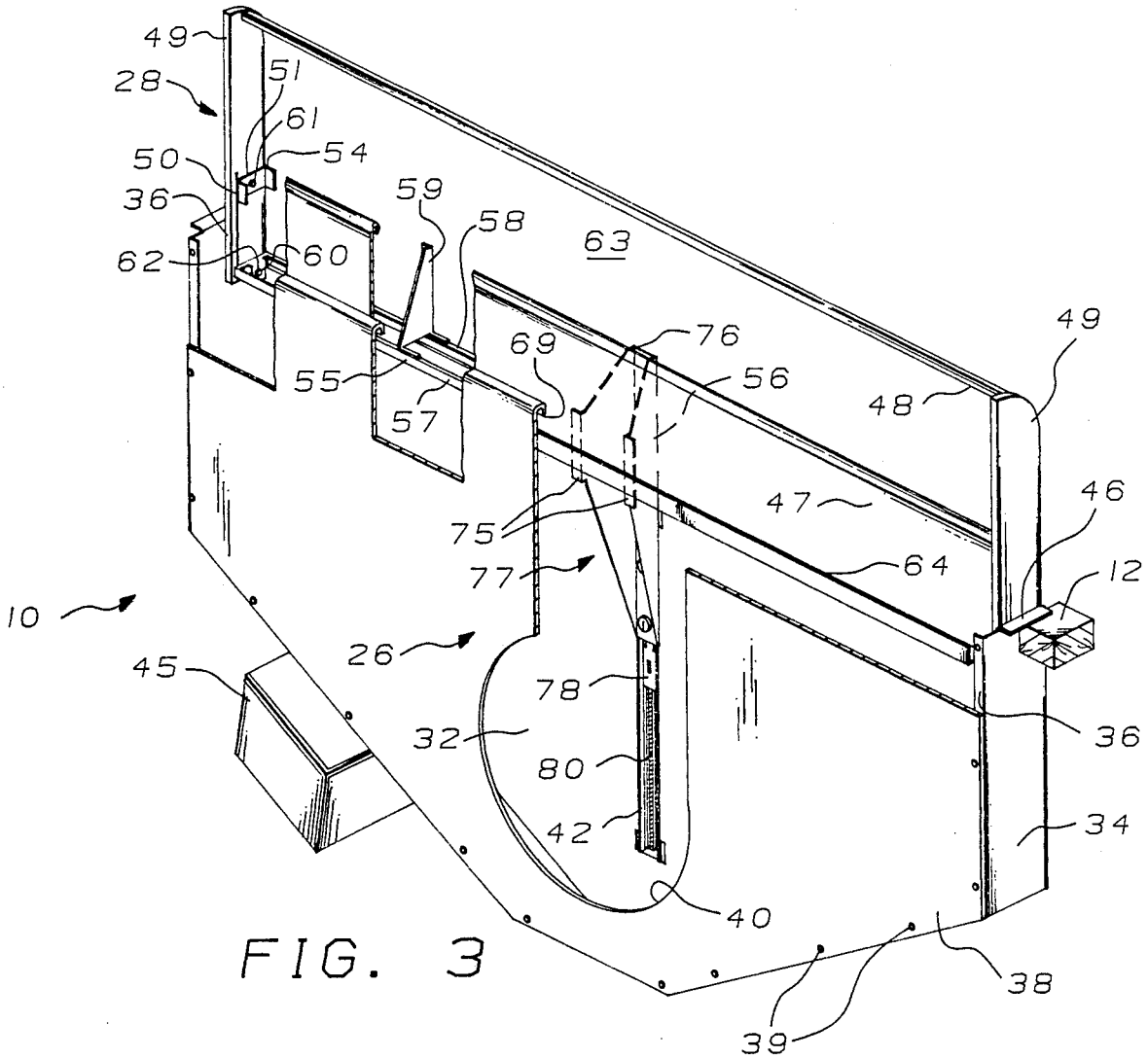
FIG. 3 is a perspective view of the vent system of FIG. 2 apart from the cooking appliance with portions broken away to illustrate details thereof.
Figure 4:
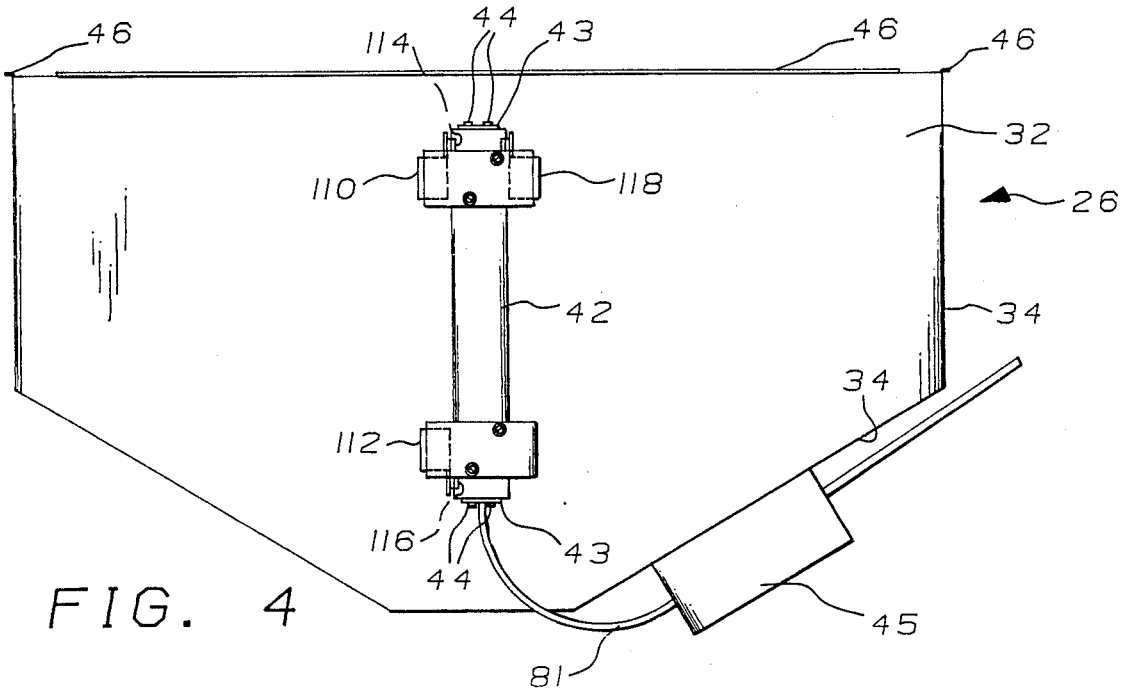
FIG. 4 is a rear plan view of the vent system of FIG. 3 with the vent inlet member in its lowered position.
Figure 5A:
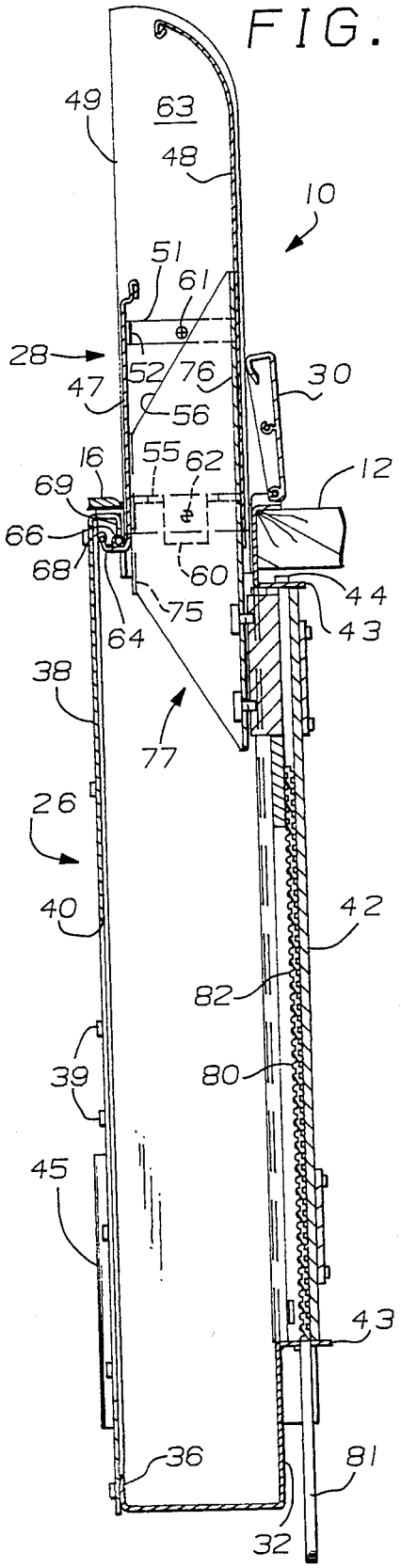
FIG. 5A is a sectional side view taken along lines 5—5 of FIG. 2 with portions of the adjacent appliance and cabinetry removed to illustrate details of the vent system.
Figure 5B:
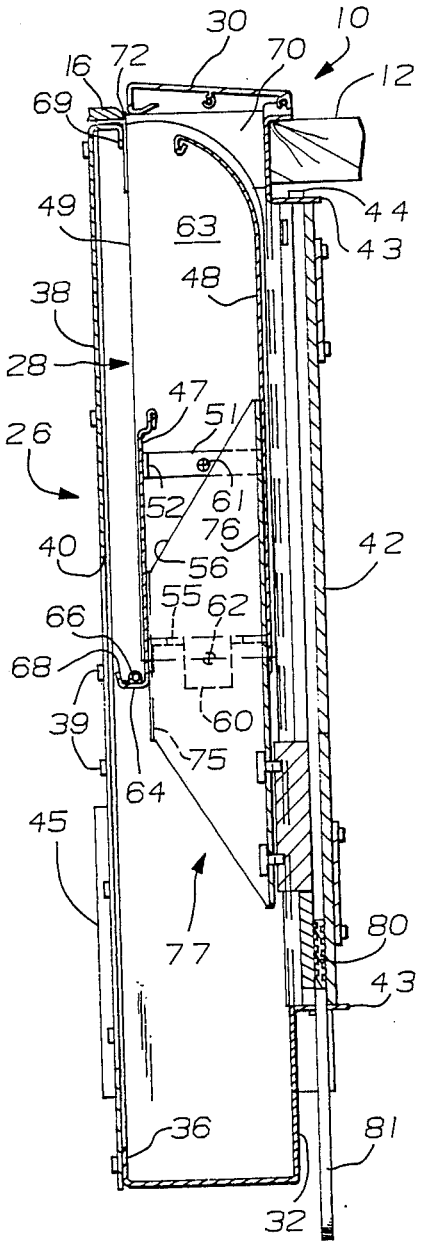
FIG. 5B is a sectional side view also taken along lines 5—5 but with the vent inlet member in its lowered position as in FIG. 1.

As best seen in FIGS. 3–5, vent system 10 comprise: a plenum 26 disposed beneath the countertop with a retractable vent inlet member 28 slidably received in plenum 26 for movement between a lowered position (FIGS. 1 and 5B) recessed to be at or below the cooktop level so as to be non-obtrusive when not in use and a raised position (FIGS. 2 and 5A) elevated with respect to the cooking surface 16 to provide a down draft vent inlet spaced sufficiently above the cooking surface to prevent the flow of air drawn into the vent from interfering with proper surface unit operation. When vent inlet member 28 is in its lowered or fully recessed position within plenum 26, a hingedly mounted cover member 30 covers the open top of the plenum. Cover member 30 is suitably biased to its closed position (FIGS. 1 and 5B) such as by a coil spring wrapped around the hinge pin (not shown). Vent inlet member 28 simply pushes cover member 30 open as it moves to its raised position.

Plenum 26 is an essentially hollow sheet metal housing comprising rear and side walls 32 and 34 respectively which may be formed out of a single sheet of sheet metal. Side walls 34 have an inwardly turned flange 36 formed along the front edge thereof. Front wall 38 of plenum 26 is also sheet metal and suitably secured to side wall flange 34 such as by sheet metal screws 39. Plenum 26 has an open top to receive retractable vent inlet member 28 which in its retracted position is fully received within plenum 26 as best seen in FIG. 5B. A circular aperture 40 is formed in the lower central region of plenum front wall 38 for communication with the exhaust blower structure (not shown), which can be conventional in construction. A vertically extending track 42 for guiding the movement of vent inlet member 28 is mounted in an elongated slot cut out of the plenum rear wall 32, with outwardly extending tabs 43 formed at the upper and lower ends thereof. Track 42 is suitably secured in the slot such as by screws 44 through tabs 43. A drive motor for raising and lowering vent inlet member 28 is contained within motor housing 45 mounted to lower side wall 34 of plenum 26. Plenum 26 is supported in the slot cut in countertop 12 by an outwardly turned flange 46 formed at the top edge of each of the plenum side and rear walls 34 and 32 to support plenum 26 from countertop 12.

Vent inlet member 28 comprises sheet metal front and back walls 47 and 48 respectively, joined at the sides by molded plastic end caps 49. As best seen in FIG. 3, front wall 47 of vent member 28 fits in a groove 50 formed in the inner face of each end cap 49. Similar grooves are provided to receive the lateral edges of rear wall 48. Front and rear walls 47 and 48 are secured to each other near the lateral edges thereof by an upper bracket 51 which has a front flange 52 suitably secured to the front wall member 47 such as by welding and a rear flange 54 similarly secured to rear wall 48.

An open rectangular frame member 55 extends along the lower edge of vent inlet member 28 from each end cap 49 to a point proximate the vertically extending channel member 56 suitably secured along its front and rear sides 57 and 58 respectively to front and rear walls 47 and 48 respectively near the bottom edges thereof such as by welding. Cross members as shown at 59 are spaced along its length and welded to frame 55 at front and rear sides 57 and 58, and rear wall 48. A tab 60 is formed at the end cap end of each support member 55. Each end cap 49 is secured in place by a screw 61 which passes through upper support bracket 51 and a screw 62 which passes through tab 60 of frame member 55.

The rear wall 48 of vent inlet member 28 extends vertically beyond, and curves forwardly toward front wall 47. The gap therebetween defines the inlet opening 63 for vent inlet member 28. Air from the area above cooking surface 16 which is drawn into vent system 10, by an exhaust blower (not shown), preferably mounted proximate opening 40, passes through the inlet opening 63 and down into the inter or of plenum 26 and out through aperture 40 to an exhaust duct (not shown) for removal to the outside air. Though not shown it will be understood that grill work may be inserted to span inlet opening 63 and air filter structure may be inserted between the front and back walls of vent inlet member 28.

A forwardly and upwardly bent lip 64 is formed along the lower edge of vent member front wall 47. A gasket member 66 is received in channel 68 formed by lip 64 along the entire length thereof. A corresponding inwardly and downwardly bent lip 69 is formed along the upper edge of plenum front wall member 38. With vent inlet member 28 in its raised position, lip 69 cooperates with lip 64 to compress gasket 66 in channel 68 to provide an essentially air tight seal therebetween to prevent air leakage into the vent system at cooktop level.

A molded plastic appearance trim piece 70 fills the gap at each end of vent member 28 between vent member end caps 49 and the countertop 12. The upper surface of trim piece 70 is contoured to provide upturned lip at 72 which matches the outer edge of cooking surface 16 to provide a finished appearance. A portion of the bottom surface of trim piece 70 is contoured to hide flange 46.

Vertically extending channel member 56 provides a sturdy structural member joining front and rear walls 47 and 48 respectively near the center of vent inlet member 28. Channel member 56 is suitably secured to vent member front wall 47 such as by welding at the outwardly bent flanges 75. Rear wall 76 of channel member 56 is similarly secured to rear wall 48 of vent inlet member 28. The lower portion 77 of channel member 56 projects beyond the lower edges of walls 47 and 48 for coupling vent inlet member 28 to a drive member carried in track 42.

In accordance with the present invention an improved driving mechanism for raising and lowering the motor driven retractable vent member comprises drive means coupling a drive motor to the vent inlet member operative to abuttingly engage the vent inlet member and positively drive the vent inlet member from its lowered to its raised position and to releasably carry the vent inlet member from its raised to its lowered position.

Figure 6:
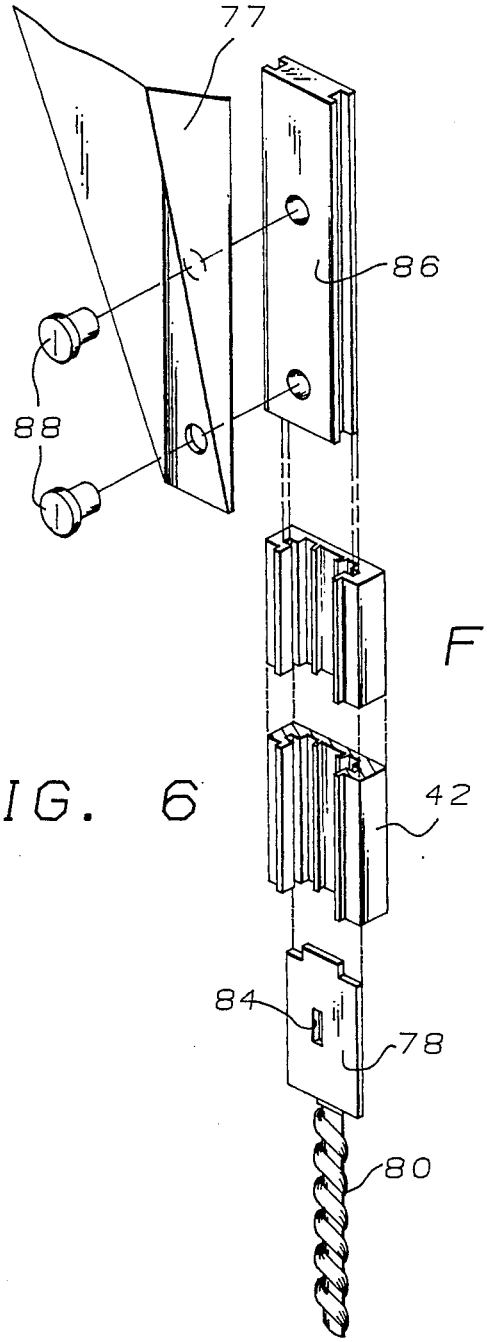
FIG. 6 is a partial exploded perspective view enlarged to show details of one embodiment of a drive mechanism of the type employed in the vent system of FIG. 1 for raising and lowering the vent inlet member.
Figure 9A:
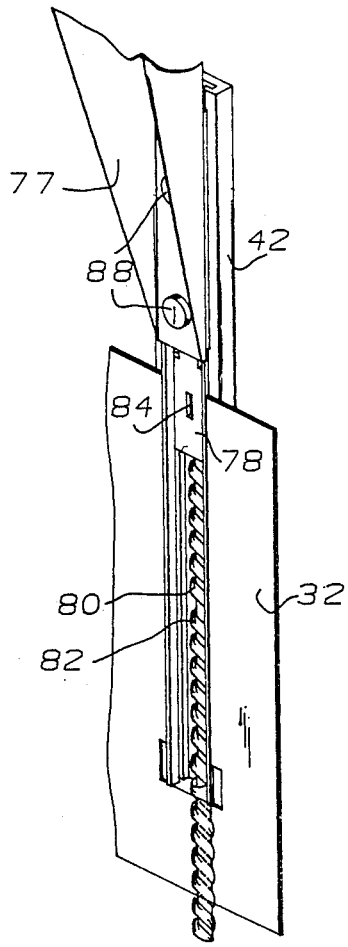
FIG. 9A is a partial perspective view of the drive mechanism illustrated in FIG. 6 with the drive mechanism and vent inlet member in the raised position.
Figure 9B:
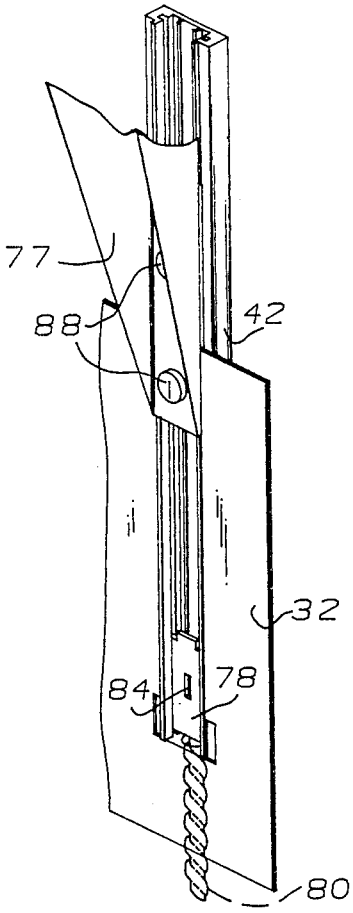
FIG. 9B is a partial perspective view of the structure of FIG. 9A showing the drive mechanism in its lowered position with the vent inlet member displaced from its lowered position as in FIG. 8.

Two embodiments of drive means in accordance with the invention will be hereinafter described. In the first embodiment illustrated in FIGS. 6, 9A and 9B, a first drive member in the form of slider 78 is slidably captured in slotted track 42, the inner side walls of which are configured to retain slider 78 within the track. Linking means positively connecting slider 78 to the drive motor in housing 45 is provided in the form of a non-rotating flocked helical cable 80 enclosed by cable sheath 81. Rotational motion of the drive motor is converted to translational motion of cable 80 by a pinion gear (not shown) driven by the motor, which engages the ridges 82 of the helical cable 80. Motor rotation in a first direction moves cable 80 upwardly in the track to raise vent inlet member 28, and rotation in the opposite direction moves cable 80 in the opposite direction to lower vent inlet member 28. Slider 78 is suitably fixedly secured to cable 80, such as by a pin through slot 84 formed in slider 78 for that purpose. A second drive member positively fixedly connected to the vent inlet member 28 and disposed for abutting engagement with the first drive member, slider 78, is provided in the form of a second slider 86, which is suitably fixedly secured to the lower portion 77 of channel member 56 such as by screws 88. Slider 86 is also slidably captured in track 42 and positioned relative to slider 78 such that in moving from its first to its second position slider 78 abuttingly drivingly engages slider 86 and drives slider 86 ahead of it along track 42. The first and second positions for slider 78 correspond respectively to the lowered and raised positions for vent inlet member 28. Thus, as slider 78 moves from its first position to its second position it drives vent inlet member 28 from its lowered to its raised position.

Figure 8:
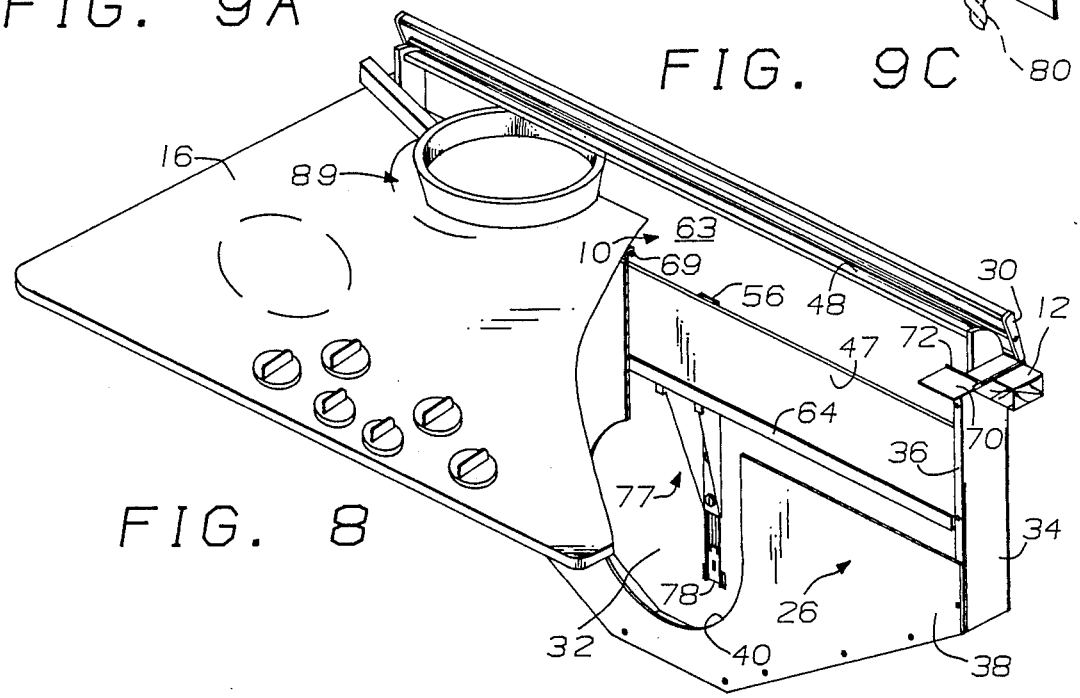
FIG. 8 is a perspective view of the down draft system and cooktop of FIG. 1 with portions removed to show the drive mechanism in its lowered position with an obstruction preventing the vent member from fully returning to its lowered position.

By this arrangement as the first drive member, slider 78, returns to its first position, the weight of vent inlet member 28 urges the second drive member, slider 86, against slider 78, causing slider 86 to follow slider 78 as it returns to its first position, thereby returning vent inlet member 28 to its lowered position. There is no positive connection between the first and second drive members. Consequently, if an obstruction, which for purposes of illustration is represented in FIG. 8 by fry pan 89, should prevent vent inlet member 28 from returning to its lowered position, the first drive member is free to return to its first position unhindered, and the only force exerted by vent inlet member 28 against the obstruction is the weight of vent inlet member 28.

Figure 10:
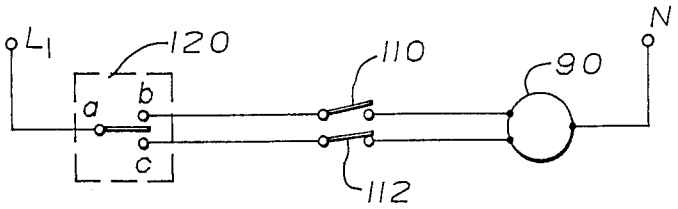
FIG. 10 is a simplified schematic view of the drive motor control circuit for a down draft vent system of the type illustrated in FIG. 1.

The drive motor enclosed in housing 45, designated 90 in the control circuit of FIG. 10, is a reversible electric motor geared to raise and lower vent inlet member 28 at a suitable rate of speed. In the illustrative embodiment motor 90 is a 1/5 hp reversible motor, geared to move vent inlet member 28 between its raised and lowered positions, a distance of about 8½ inches, in approximately 6½ seconds.

Figure 7:
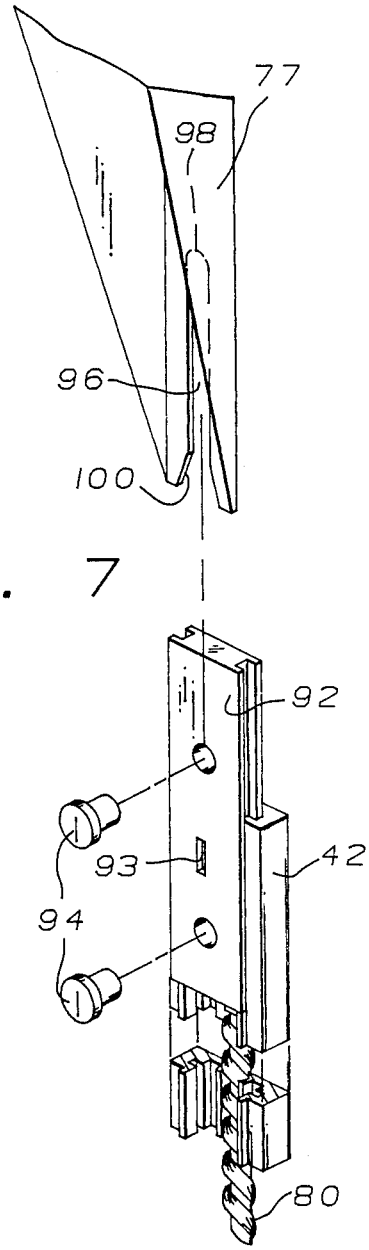
FIG. 7 is a partial exploded perspective view enlarged to show details of an alternative embodiment for a drive mechanism of the type employed in the vent system as shown in FIG. 1.
Figure 9C:
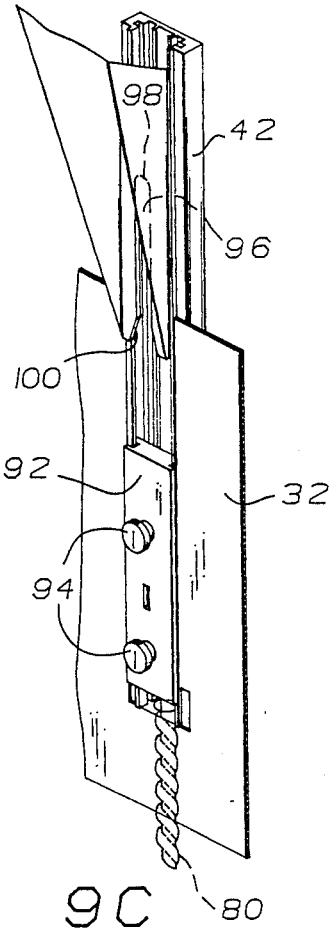
FIG. 9C is a partial perspective view of a portion of the alternative embodiment of the drive mechanism of FIG. 7 showing the drive mechanism in its lowered position with the vent inlet member displaced from its lowered position as if obstructed as in FIG. 8.

In accordance with a second embodiment of the drive mechanism of the present invention illustrated in FIGS. 7 and 9C, a first drive member is provided in the form of slider 92 which is a slightly elongated version of slider 86 of the first embodiment, and which is fixedly attached to cable 80 by a pin passing through slot 93. Slider member 92 carries two pins or screws 94 vertically spaced in alignment with the center line of track 42 when slider 92 is slidably secured in the track. In this embodiment the second drive member comprises the lower portion 77 of channel member 56 which projects from vent inlet member 28 proximate track 42 for abutting engagement with the first drive member, slider 92. More specifically, lower portion 77 of channel member 56 has an elongated vertically extending slot 96 with a closed top end 98 and an open bottom end 100, formed in the rear channel wall 76. When vent inlet member 28 is properly positioned in plenum 26, pins 94 are slidably received in slot 96. The bottom end 100 of slot 96 is slightly flared to facilitate engagement with pins 94.

As the first drive member is driven by motor driven cable 80 from its first position to its second position, the topmost one of pins 94 abuttingly engages the closed end 98 of slot 96 to drive vent inlet member 28 to its raised position. As in the first embodiment, there is no positive connection between the first drive member, slider 92, and the second drive member, portion 77 of channel member 56. The second drive member is driven by the weight of vent inlet member 28 to follow motor driven slider 92 as it moves from its second to its first position. Thus, as best seen in FIG. 9C, if an obstruction blocks the return of vent inlet member 28 to its lowered position (FIG. 8), pins 94, carried by slider member 92, disengage slot 96 and slider 92 returns to its first position unhindered. In both embodiments removal of the obstruction releases vent inlet member 28 to return to its lowered position.

As best seen in FIG. 4, limit switches 110 and 112 are disposed at opposite ends of track 42 to de-energize drive motor 90 when the vent inlet member 28 arrives at its raised and lowered positions respectively. Switch 110 is mounted near the upper end of track 42 with an actuating member 114 projecting into the interior of track 42 through the side wall thereof, for actuation when the first drive member, slider 78 in the first embodiment and slider 92 in the second embodiment, reaches its second position, corresponding to vent inlet member 28 being in its raised position. Switch 112 is positioned proximate the lower end of track 78, with actuating member 116 projecting through an opening in the track side wall for actuation by the first drive member in its first position, corresponding to vent inlet member 28 being in its lowered position. A third limit switch 118 similarly disposed on the other side of track 42 directly opposite switch 110 enables energization of the blower motor (not shown) only when vent inlet member 28 is in its raised position.

A simplified schematic for controlling drive motor 90 is shown in FIG. 10. Switches 110 and 112 are normally closed switches arranged to switch open when actuated by a slider in track 42. Switch 120 is a three position switch actuated by user manipulation of control knob 24 (FIG. 1). Switch 120 is spring biased to the neutral or open position illustrated in FIG. 10. Drive motor 90 is connected across power lines L1 and N for rotation in the appropriate direction for raising vent inlet member 28 via normally closed switch 110 and terminals a and b of switch 120, and for rotation in the opposite direction for lowering vent inlet member 28 via normally closed switch 112 and terminals a and c of switch 120.

To raise vent inlet member 28, knob 24 is rotated clockwise to close switch 120 across contacts a and b. This energizes motor 90 to raise the vent, via normally closed switch 110 which remains closed until actuated when vent inlet member 28 arrives at its raised position which de-energizes motor 90. To lower vent inlet member 28, control knob 24 is rotated counterclockwise from its neutral position to close switch 120 across contacts a and c. This energizes motor 90 for rotation in the opposite direction to lower the vent. Switch 112 remains closed until actuated by the return of the first drive member to its first position which de-energizes motor 90.

While in accordance with the Patent Statutes, a specific embodiment of the present invention has been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. An improved vent driving mechanism for a motor driven retractable down draft vent system of the type having a vent inlet member vertically movable between a lowered position and a raised position, and a motor for controlling movement of the vent inlet member, the improvement comprising drive means coupling the motor to the vent inlet member operative to abuttingly engage the vent inlet member to positively drive the vent inlet member from its lowered to its raised position and to releasably carry the vent inlet member from its raised to its lowered position.

2. The improvement of claim 1 wherein said drive means comprises a first drive member, movable between a first position and a second position; linking means fixedly connecting the motor to said first drive member for positively driving said first drive member between its first and second positions; a second drive member positively connected to the vent inlet member disposed for abutting engagement with said first drive member; said first drive member drivingly abuttingly engaging said second drive member in moving from its first to its second position thereby positively driving the vent inlet member from its lowered to its raised position; said second member being driven by the weight of the vent inlet member to follow said first drive member when said first drive member returns from its second to its first position whereby the vent inlet member is releasably carried by said first drive member to its lowered position.

3. In a motor driven retractable down draft vent system for a cooking appliance, the vent system including a vent member mounted for vertical movement between a lowered position and a raised position; a guide track; a first drive member slidably captured in the track for vertical movement therein, a motor, linking means positively connecting the first drive member and the motor for moving the first drive member between a first position and a second position; the improvement comprising a second drive member fixedly connected to the vent inlet member and disposed for abutting engagement with the first drive member as said first drive member moves from its first to its second position, the first drive member being operative to drivingly abuttingly engage said second drive member, thereby driving the vent inlet member from its lowered to its raised position as said first drive member moves from its first to its second position; said second member being driven by the weight of the vent inlet member to engage and follow said first drive member as it returns from its second to its first position, whereby in the event an obstruction prevents the vent inlet member from returning to its lowered position, said first drive member disengages said second drive member and continues to its first position unaffected by such obstruction.

4. The improvement of claim 3 wherein the first drive member comprises at least one pin projecting therefrom and said second drive member has formed therein a vertically extending slot having an upper closed end and a lower open end for slidably receiving said pin, said pin abuttingly engaging the closed end of said slot to drive the vent inlet member to its raised position as the first drive member moves from its first position to its second position; said pin disengaging said slot in moving from its second to its first position if an obstruction should prevent the vent inlet member from returning to its lowered position.

5. An improved drive mechanism for a down draft vent system of the type having a motor driven retractable vent inlet member slidably received in a plenum for motor controlled movement between a lowered position within the plenum and a raised position extending above the plenum and having a vertically extending track supported from the plenum for guiding the movement of the vent inlet member, the drive mechanism comprising:

a first drive member slidably captured in the track for movement therein between a first position and a second position;

linking means fixedly connecting the motor to said first drive member to positively drive said first drive member between its first and second positions;

a second drive member fixedly connected to the vent inlet member and disposed for abutting engagement with said first drive member; said first drive member being operative to drivingly abuttingly engage said second drive member in moving from its first position to its second position thereby driving the vent inlet member from its lowered to its raised position, said second drive member being driven by the weight of the vent inlet member to follow said first drive member as it moves from its second to its first position, whereby said first drive member carries the vent inlet member to its lowered position, said first drive member being free to disengage said second drive member and continue to its first position unhindered by any obstacle which might prevent the vent inlet member from returning to its lowered position.

6. The improvement of claim 5 wherein the first drive member comprises at least one pin projecting therefrom and said second drive member has formed therein a vertically extending slot having an upper closed end and a lower open end for slidably receiving said pin, said pin abuttingly engaging the closed end of said slot to drive the vent inlet member to its raised position as said first drive member moves from its first to its second position; said pin disengaging said slot in moving from its second to its first position if an obstruction should prevent the vent inlet member from returning to its lowered position.

* * * * *